US012612768B2

(12) United States Patent
Knuchel

(10) Patent No.: US 12,612,768 B2
(45) Date of Patent: Apr. 28, 2026

(54) SYSTEM FORMED OF SEVERAL IMUS

(71) Applicant: Contelec AG, Biel/Bienne (CH)

(72) Inventor: Fabian Knuchel, Grenchen (CH)

(73) Assignee: Contelec AG, Biel/Bienne (CH)

( * ) Notice: Subject to any disclaimer, the term of this patent is extended or adjusted under 35 U.S.C. 154(b) by 193 days.

(21) Appl. No.: 18/203,573

(22) Filed: May 30, 2023

(65) Prior Publication Data

US 2023/0392355 A1 Dec. 7, 2023

(30) Foreign Application Priority Data

Jun. 1, 2022 (EP) ..... 22176786

(51) Int. Cl.
*E02F 9/26* (2006.01)
*E02F 9/20* (2006.01)

(52) U.S. Cl.
CPC ..... *E02F 9/265* (2013.01); *E02F 9/2025* (2013.01)

(58) Field of Classification Search
CPC ..... E02F 3/301; E02F 9/2025; E02F 9/264; E02F 9/265; G01C 21/16
See application file for complete search history.

(56) References Cited

U.S. PATENT DOCUMENTS 5,023,808 A * 6/1991 Seraji ..... B25J 9/163 901/45
8,942,846 B2 * 1/2015 Jacobsen ..... B25J 9/0084 700/262
10,401,176 B2 * 9/2019 Nackers ..... E02F 3/434
10,521,703 B2 * 12/2019 Beschorner ..... G01C 21/183
10,724,842 B2 7/2020 Alam
10,905,042 B2 * 2/2021 Shinkai ..... G05D 1/0219
11,834,813 B2 * 12/2023 Kalantar ..... E02F 9/265
12,011,245 B2 * 6/2024 Wang ..... A61B 17/00234
2008/0093498 A1 * 4/2008 Leal ..... F41G 7/2206 244/3.22
2013/0011220 A1 * 1/2013 Jacobsen ..... B25J 13/025 414/2
2016/0120095 A1 * 5/2016 Fujimoto ..... G05D 1/0295 701/24
2016/0353669 A1 * 12/2016 Xavier ..... A01G 3/08
(Continued)

FOREIGN PATENT DOCUMENTS

DE 102018118147 A1 1/2020
DE 102021100324 A1 7/2021

OTHER PUBLICATIONS

Salehi, Sarvenaz et al., "A Low-cost and Light-weight Motion Tracking Suit," 2013 IEEE 10th International Conference on Ubiquitous Intelligence and Computing and 2013 IEEE 10th International Conference on Autonomic and Trusted Computing, IEEE, Dec. 18, 2013; pp. 474-479; 6 pages.

*Primary Examiner* — Tyler J Lee
(74) *Attorney, Agent, or Firm* — Avyno Law P.C.

(57) ABSTRACT

The invention relates to a system formed of several IMUs (1, 2, 3, 4, 5) having at least one slave IMU (1, 2, 3, 4) that is configured to record and transmit data. A master IMU (5) having an analysis computing unit is additionally provided which is configured to record data itself and to receive data from the at least one slave IMU (1, 2, 3, 4) and to jointly analyse the data for a calculation of a kinematic chain and to transmit the analysed data to an electronic control device of a machine connected with the system.

12 Claims, 2 Drawing Sheets

(56) References Cited

U.S. PATENT DOCUMENTS

| | | | | |
|---|---|---|---|---|
| 2017/0008591 | A1* | 1/2017 | Abbott | B62K 5/08 |
| 2018/0338408 | A1* | 11/2018 | Shinkai | G05D 1/0287 |
| 2018/0372498 | A1* | 12/2018 | Nackers | E02F 3/434 |
| 2018/0373275 | A1 | 12/2018 | Beschorner et al. | |
| 2018/0373966 | A1* | 12/2018 | Beschorner | G01C 21/10 |
| 2019/0242687 | A1 | 8/2019 | Alam | |
| 2020/0200537 | A1* | 6/2020 | Ceisel | E02F 3/841 |
| 2021/0251708 | A1* | 8/2021 | Wang | A61B 17/00234 |
| 2023/0018606 | A1* | 1/2023 | Kalantar | G01B 21/22 |
| 2023/0047358 | A1* | 2/2023 | Balter | G09B 23/28 |
| 2023/0340759 | A1* | 10/2023 | Bruflodt | G05D 1/0038 |

* cited by examiner

SYSTEM FORMED OF SEVERAL IMUS

RELATED APPLICATIONS

This application claims priority to European Patent Application No. 22176786.6, filed Jun. 1, 2022, the entire contents of which are incorporated by reference in this application.

FIELD OF THE INVENTION

The present invention relates to a system formed of inertial measurement units (referred to in the following as IMU(s)), which can measure rotation rates and/or accelerations. The system formed of IMUs is used in machinery and their tools.

BACKGROUND

An inertial measurement unit consists of several inertial sensors, in particular of acceleration sensors, which measure the acceleration in three dimensions, and gyroscopes, which measure the rotation rates—so the angular velocity—in three dimensions. From this data, the position and the (angular) velocity of an object on which the IMU is fixed can be measured. The position in a global coordinate system is determined by means of measuring the vector of the Earth's gravity in relation to the position of the IMU. If the object moves, errors can thereby occur in the measuring of the acceleration sensors, which errors are compensated for by sensor fusion by means of the data from the gyroscopes.

Nowadays, systems of IMUs are used for an automated or semi-automated controlling of machinery. The IMUs are, for example, arranged on a tool arm of the machinery and there measure the acceleration and the rotation rate. A concrete application example are diggers, excavators and similar, in which the IMUs are arranged on the digger arm and, optionally, on the upper carriage.

Several approaches for controlling and analysing the IMUs are known. On the one hand, individual IMUs can be provided, which, with the help of the incline, record the absolute position of the tool arm. The individual IMUs hereby operate independently of the other IMUs on the machinery and also do not receive any data from these. Consequently, the individual IMUs do not know their position on the machinery themselves, so that these cannot compensate optimally for the occurring acceleration.

On the other hand, combined systems of IMUs and an additional central control unit are provided. The IMUs are connected with the central control unit and send the latter the data measured by the individual IMUs. The data can already be pre-processed by the IMUs or can be sent directly to the central control unit as raw data—so the measured acceleration and the measured rotation rate. The central control unit then calculates the position, the (angular) velocity, the incline and/or the intermediate angles between the IMUs from the data. The central control unit is thereby a control device that must be specially installed in the machinery or a control device already present in the machinery. Such combined systems with an additional central control device are usually very expensive and cannot easily be retrofitted. Such a solution is, for example, known from U.S. Pat. No. 10,724,842 B2.

The aim of the invention is to provide a system formed of IMUs that works in conjunction with, but does not necessitate an additional central control device.

SUMMARY

A system formed of several IMUs is proposed, which has at least one slave IMU and a master IMU. The IMUs are in particular connected via a CAN bus (controller area network). The at least one slave IMU is configured to record data and to transmit it within the system. The data is rotation rates and/or accelerations of the objects on which the at least one slave IMU is arranged. The data can be recorded and transmitted as raw data directly from the measuring. In this case, the slave IMU manages with its own analysis and/or processing unit, which keeps the production costs low. Alternatively, the at least one slave IMU can have a processing unit, which is configured to carry out a pre-processing of the recorded data. For example, a direction cosine matrix (DCM) can be calculated from the raw data, which is then transmitted. By means of pre-processing the data, which can be carried out in a decentralized manner in the slave IMUs, the subsequent central analysis is simplified. For transmitting, the slave IMU can have a transmission device.

According to the invention, one of the IMUs of the system is formed as the master IMU, which differs from the slave IMUs in that it has an analysis computing unit. Like the slave IMUs, the master IMU is also configured to record data itself. The data is also rotation rates and/or accelerations of the objects on which the master IMU is arranged. Additionally, the master IMU is configured to receive the data from the at least one above-mentioned slave IMU. The analysis computing unit can be used for this. Alternatively, the master IMU has an additional transmission device, in order to receive the data from the at least one slave IMU. By means of the analysis computing unit, the master IMU is configured to jointly analyse the data of the at least one slave IMU and the data recorded by itself, in order to determine a kinematic chain. The positions and the angles of the master IMU and/or of the at least one slave IMU and the object on which the at least one slave IMU or the master IMU is arranged can thereby be calculated. The analysis computing unit of the master IMU is a significantly more powerful computing unit in comparison to the transmission device and to the pre-processing unit of the slave IMU. The master IMU then sends the analysed data to a control device of a machine connected with the system. The master IMU can have a transmission device for transmitting the calculated data to the control device of the machine.

Even two IMUs, a slave IMU and a master IMU are thus enough in order to realise the system according to the invention. However, several slave IMUs can also be provided, which are connected with the same master IMU and transmit the data to this. In a preferred system, all IMUs except one are formed as slave IMUs. Costs are thereby reduced, since only the master IMU has to include a computing unit that can carry out an analysis. In practice, up to four slave IMUs and a master IMU has proven to be especially advantageous. Other configurations, for example more than four slave IMUs and one master IMU, are, however, also possible.

It is thereby also possible to form redundant systems, in which, for example, several slave IMUs are arranged on the same link of the kinematic chain. Partially redundant systems are also possible, in which, for example, two IMU systems are mounted in a shared housing and are supplied via one power supply and communicate via the same CAN bus. Such redundant systems increase the functional security of the overall system.

In the system, the several IMUs are connected with each other, and the data is analysed jointly. However, no additional control device with which the IMUs are connected is necessary. The analysis occurs inside the system, in the master IMU. The system can thereby be implemented in the machinery in a simple manner, without having to install an additional control device, for example in the interior of the machinery, or change an electronic control device of the machinery that is already provided. The slave IMUs are preferably only connected with the master IMU, via signalling. The master IMU can additionally have a user interface, or be connected with one.

Preferably, the master IMU transmits the position data of the at least one slave IMU to this after the analysis. In this case, the master IMU is therefore configured to send data to the at least one slave IMUs, and the at least one slave IMU is configured to receive data from the master IMU. The at least one slave IMU thereby receives information about its position and location. This information can then, in turn, be incorporated into the pre-processing. All IMUs can thereby receive information relevant to them.

Optionally, at least one angle sensor can be provided, which records the angle of an object on which it is arranged to a neighbouring object of the kinematic chain. Different types of angle sensor could be provided. An angle sensor is preferably arranged in the respective rotational centre of the objects or is at least mechanically connected with this. This angle sensor is, in particular, arranged at the start of the kinematic chain. Another angle sensor is preferably formed as a segment sensor. A segment sensor typically measures in an angular range smaller than 180°, and does not have to be arranged in the rotational centre. The segment sensor is, in particular, arranged at the end of the kinematic chain, since such a segment sensor, especially in comparison with an IMU, is less sensitive with regard to strong vibrations and blows, which typically occur on the end of the kinematic chain. The data of the at least one angle sensor is transmitted to the master IMU and is there included in the analysis. By means of the angle sensor, the angular position and the angular velocity can often be better recorded than by only using IMUs. For example, the angular position can also be recorded when the orientation is horizontal, which is not the case with IMUs. A more exact compensation of the centripetal acceleration is thus possible.

If several slave IMUs are provided, the master IMU can calculate the intermediate angle between the individual slave IMUs and/or the master IMU from the jointly analysed data, during the analysis. Alternatively, the master IMU can calculate the absolute angle of individual IMUs in relation to a reference from the jointly analysed data, during the analysis. The vertical is in particular used as a reference.

The system according to the invention formed of IMUs can be used in a digger. The IMUs on the digger are thereby arranged on its digger arm. Generally, the master IMU can be arranged anywhere on the digger. Preferably, the master IMU is arranged on the upper carriage of the digger and the slave IMUs are arranged on the digger arm and, optionally, on the tool. The master IMU can thereby record the position and rotation rate of the upper carriage and thus of the first link of the kinematic chain.

DETAILED DESCRIPTION OF THE INVENTION

Figure 1:
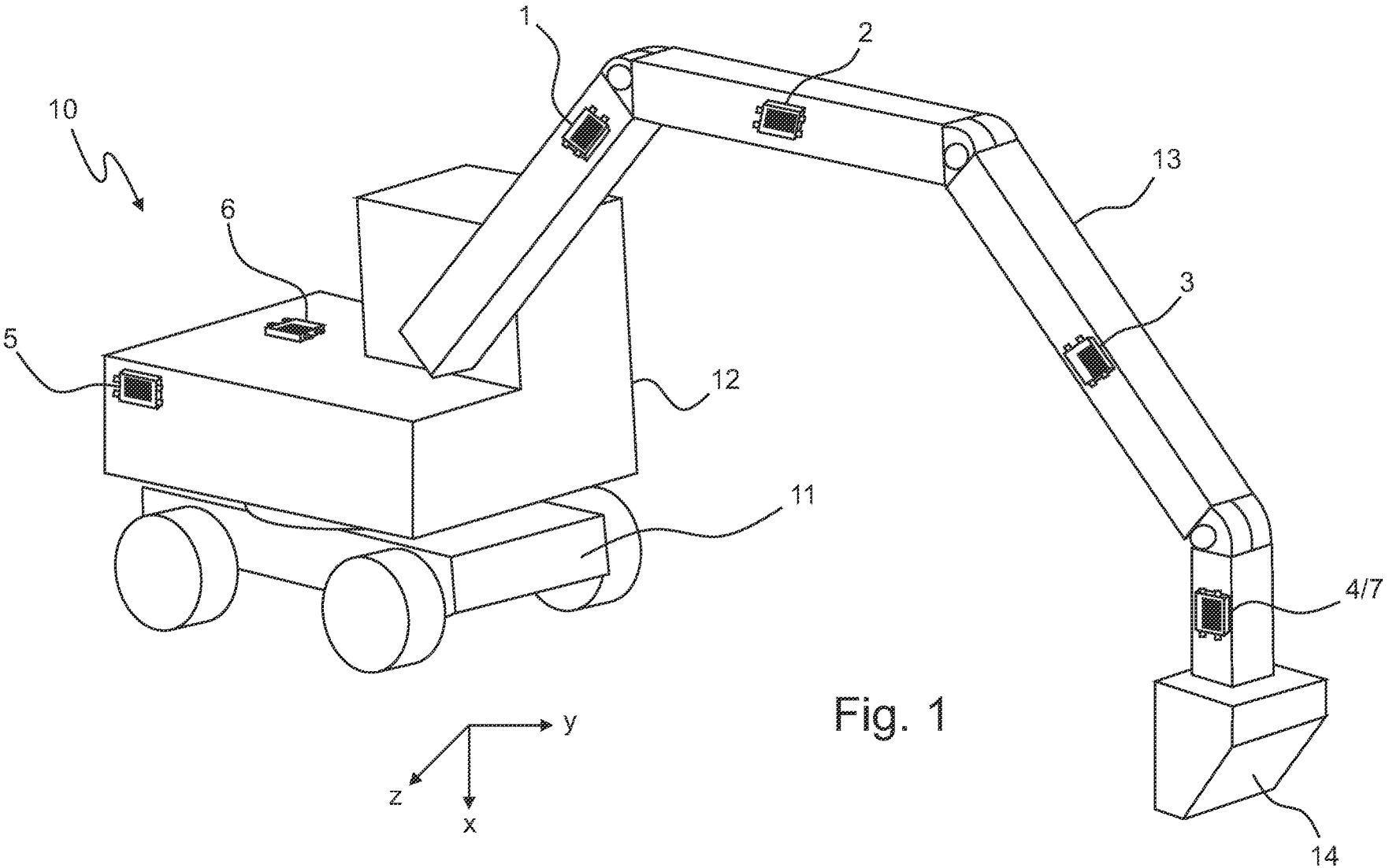
FIG. 1 shows a schematic oblique view of a digger, which has the system formed of IMUs according to the invention.
Figure 2:
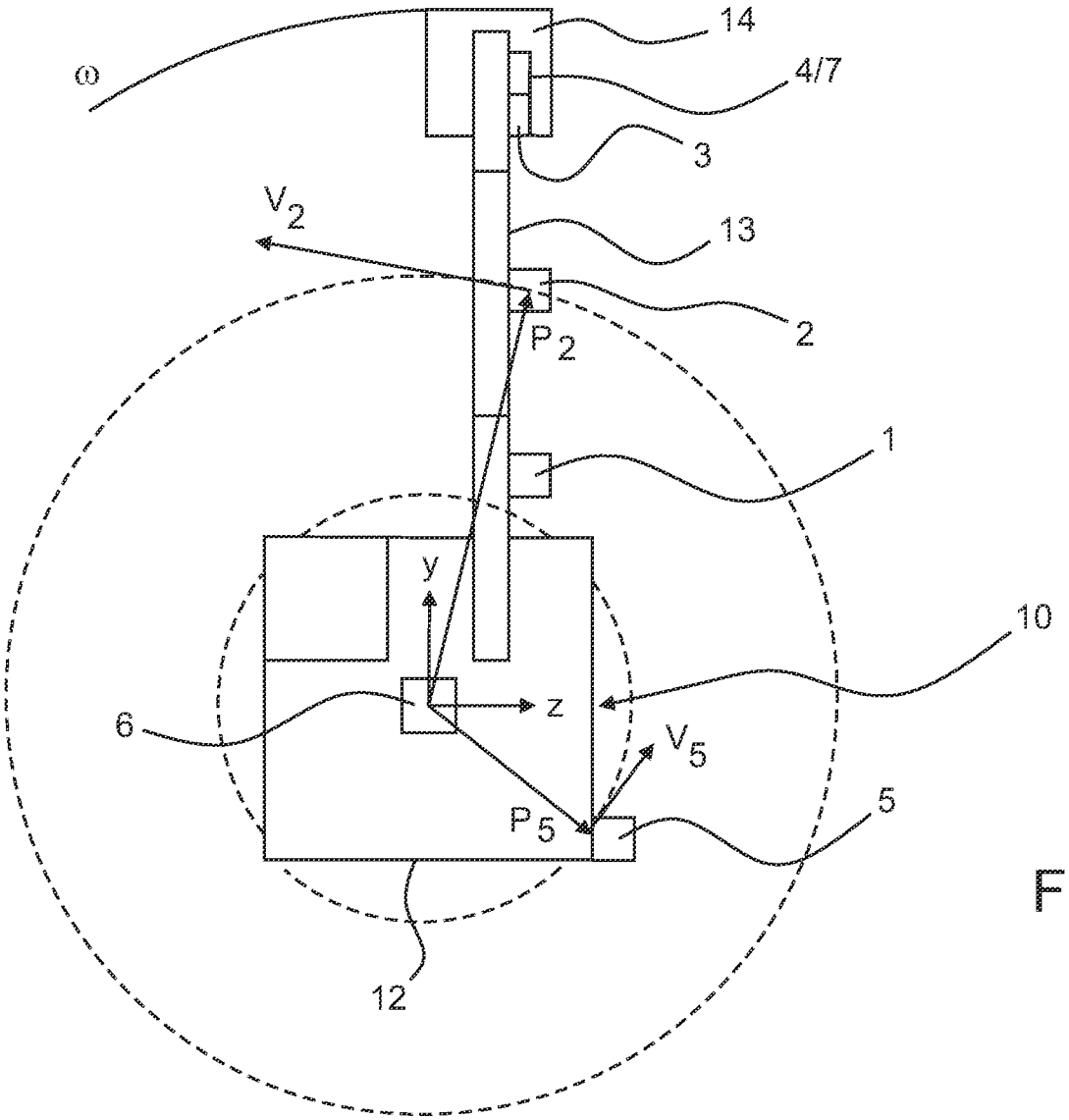
FIG. 2 shows a schematic plan view of a digger from FIG. 1.

In the FIGS. 1 and 2, a digger 10 with an undercarriage 11 and an upper carriage 12 that is arranged rotatably on the undercarriage 11 is shown. A digger arm 13, which here consists of four segments which can be tilted towards each other and towards the upper carriage 12, is arranged on the upper carriage 12. A digger shovel 14 is arranged on the last segment of the digger arm 13 as a tool.

According to the invention, several IMUs 1, 2, 3, 4, 5 are provided, which are implemented on the upper carriage 12 and on the digger arm 13. A slave IMU 1, 2, 3, 4 is arranged on every segment of the digger arm, which records an acceleration, in particular relative to the Earth's gravity in the X direction, and a rotation rate of the respective segment of the digger arm 13. The slave IMUs 1, 2, 3, 4 have no analysis computing unit, which is configured for the complete analysis of data. However, they can have a less powerful processing unit, with which raw data can be pre-processed. Additionally, the slave IMUs can have a transmission device with which data can be transmitted by a CAN bus. A master IMU 5 which records an acceleration and a rotation rate of the upper carriage 12 is arranged on the upper carriage 12. The slave IMUs 1, 2, 3, 4 are connected with the master IMU 5 via the CAN bus and send the recorded data to the master IMU 5. The data can either be transmitted directly as recorded raw data or can be pre-processed beforehand and then transmitted to the master IMU 5 as pre-processed data, for example as DCM.

Additionally, an angle sensor 6 is provided on the upper carriage 12, which is arranged in the rotational centre, or is otherwise mechanically connected with the rotational centre and which records the angle relative to the undercarriage 11 in the Y-Z plane perpendicular to the Earth's gravity. The angle sensor 6 is also connected with the master IMU 5 and sends this the angle data. On the connection between the shovel 14 and the digger arm 13, a further angle sensor can be provided instead of the slave IMU 4 or additionally to this, which is preferably formed as a segment sensor 7. The segment sensor 7 measures the angle between the shovel 14 and the last section of the digger arm 13 and is arranged outside of the rotational centre for this. The segment sensor 7 is also connected with the master IMU 5 and sends this the angle data. During operation, strong vibrations and blows occur on the digger shovel 14. The segment sensor 7 is affected less by this in comparison to the slave IMU 4. The master IMU 5 has a transmission device with which the data of the slave IMUs 1, 2, 3, 4 and the angle sensors 6, 7 is received via the CAN bus. Further, the master IMU 5 has an analysis computing unit with which the data of the slave IMUs 1, 2, 3, 4, the recorded data of the master IMU 5 and the data of the angle sensor 6 and, optionally, the data of the segment sensor 7 is jointly analysed. The analysed data is transmitted to a control device (not shown) of the digger 10 by means of the transmission device.

In FIG. 2, an example is shown of calculating the speed $v_2$ of the slave IMU 2 on the second segment of the digger arm 13 (referred to as the second IMU 2 in the following) and the speed vs of the master IMU 5 on the upper carriage 12. The digger arm 13 is rotated with and by means of the rotation of the upper carriage 12 with respect to the undercarriage 11. The speeds $v_2$ and vs are thus tangential to the circular path on which the upper carriage 12 is turning, and they are thus dependent on its angular velocity ω. The master IMU 5 determines the angle of the upper carriage 12 relative to the undercarriage 11 using the additional data of the angle sensor 6. Additionally, the absolute position $P_5$ of the master IMU 5 in the global coordinate system (only the Y-Z plane is represented in FIG. 2) is recorded. The master IMU 5 can record its absolute angle in the global coordinate system for this. Alternatively or additionally, the angle sensor 6 can record its angle position, from which the position $P_5$ can be determined. The movement of the undercarriage 11 during driving operation can hereby also be recorded, and the different behaviour of different drive types, like e.g. caterpillar drive or wheel drive, can be taken into consideration.

In FIG. 2, only the simple case is considered, in which the speed vs of the master IMU 5 is merely a tangential speed to the radius of the rotational centre of the digger 10. For the calculation of the speed vs of the master IMU 5, the position $P_5$ of the master IMU 5 and the angular velocity ω of the upper carriage 12 are used in a manner known per se. The calculation occurs directly in the analysis computing unit of the master IMU 5. The speed $v_2$ of the second IMU 2 is calculated from the position $P_2$ of the second slave IMU 2 and the angular velocity ω of the upper carriage 12, also in a manner known per se. The position $P_2$ of the second slave IMU 2 is calculated from the recorded acceleration and rotation rate data of the second slave IMU 2 on the second segment, the slave IMU 1 on the first segment of the digger arm 13 and the master IMU 5 on the upper carriage 12. The data of the slave IMUs 1, 2 is forwarded to the master IMU 5 and the calculation also occurs in the analysis computing unit of the master IMU 5. For calculating the position $P_2$ of the second slave IMU 2, the master IMU 5 can calculate the absolute angle of the second slave IMU 2 to the X axis of the global coordinate system. Especially for the position component in the X direction, the master IMU 5 can alternatively determine the intermediate angle between the master IMU 5 and the slave IMU 1 on the first segment and the intermediate angle between the slave IMU 1 on the first segment and the second slave IMU 2. The information about the position $P_2$ is lastly transmitted from the master IMU 5 to the second slave IMU 2.

The invention claimed is:

1. System formed of several IMUs (1, 2, 3, 4, 5) arranged on a digger (10) having at least one slave IMU (1, 2, 3, 4) which is configured to record and transmit data, in real-time, the system comprising: a master IMU (5) for measuring the acceleration and rotation rates of the object at the location upon which the IMU (5) is positioned, the IMU (5) having an analysis computing unit which is configured to record data itself and to receive data from the at least one slave IMU (1, 2, 3, 4) for measuring the acceleration and rotation rates of the object at the location upon which the at least one slave IMU (1, 2, 3, 4) is positioned, where the IMU (5) jointly analyses the data recorded by the IMU (5) and the at least one slave IMU (1,2,3,4) for a calculation of a kinematic chain and transmits the analysed data to an electronic control device of a digger (10) in communication with the system, characterised in that the at least one slave IMU (1, 2, 3, 4) has a processing unit which is configured to carry out a pre-processing of the recorded data and in that the master IMU (5) transmits the analyzed data which includes the position data of at least one of the at least one slave IMU (1, 2, 3, 4) to the electronic control device of the digger (10), in real time, without the system requiring a separate electronic control device from that of the electronic control device of the digger (10), where the electronic control device of the digger uses the received recorded and analysed data to control the operation of the digger (10).

2. The system according to claim 1, characterised in that the master IMU has a transmission device that is configured to receive the data from the at least one slave IMU and/or to transmit the analysed data to the electronic control device of the digger (10).

3. The system according to claim 1, characterised by at least one angle sensor (6, 7) which determines the angle between two links of the kinematic chain.

4. The system according to claim 3, characterised in that an angle sensor is arranged at an end of the kinematic chain and is formed as a segment sensor.

5. The system according to claim 1, characterised in that several slave IMUs (1, 2, 3, 4) are provided and in that the master IMU is configured to calculate the intermediate angles between the individual slave IMUs (1, 2, 3, 4) and/or between the master IMU (5) and the individual slave IMUs (1, 2, 3, 4) or the absolute angles of the individual IMUs (1, 2, 3, 4, 5) to a reference from the jointly analysed data.

6. The system according to claim 1, characterised in that the master IMU (5) is arranged on an upper carriage (12) of the digger (10).

7. System formed of several IMUs (1, 2, 3, 4, 5) arranged on machinery (10) having a kinematic chain, the machinery (10) having at least one arm with a tool attached thereto and an integrated electronic control system for controlling the movement of the arm and the tool of the machinery, the system comprising:

at least one slave IMU (1, 2, 3, 4) and one master IMU (5), where at least one of the at least one slave IMU (1, 2, 3, 4) and the one master IMU (5) is arranged on an arm of the machinery (10);

where both the at least one slave IMU (1, 2, 3, 4) and one master IMU (5) measure the acceleration and rotation rates of the machinery (10) at the location upon which the IMU (1,2,3,4,5) is positioned and records data related to such measurements, and where the at least one slave IMU (1,2, 3, 4) transmits the recorded data to the IMU (5);

the IMU (5) has an analysis computing unit for receiving the recorded data from the at least one IMU (1,2,3,4), for analyzing both the data recorded by the IMU (5) and the at least one slave IMU (1,2,3,4) for calculating the positioning of at least one link on the kinematic chain and for transmitting the analyzed data to the electronic control device of the machinery (10), where the at least one slave IMU (1, 2, 3, 4) has a processing unit which is configured to carry out a pre-processing of the recorded data and where the master IMU (5) transmits the analysed data of both the at least one slave IMU (1, 2, 3, 4) and the master IMU (5) to the electronic control device of the machinery without the system requiring a separate electronic control device from that of the electronic control device of the machinery (10), where the electronic control device of the machinery (10) receives data regarding the position of the arm of the machinery to properly control the position of the tool in performance of the operation of the machinery.

8. The system according to claim 7, characterised in that the master IMU (5) is arranged on an upper carriage (12) of the machinery (10).

9. The system according to claim 7, where the arm of the machinery has at least two segments and where at least one IMU (1,2,3,4) includes at least two IMUs (1, 2, 3, 4) where at least one of the two IMUs (1, 2, 3, 4) is arranged on each of the at least two segments of the arm of the machinery.

10. The system according to claim 7 further comprising at least one angle sensor (6, 7) positioned on at least one link of the kinematic chain of the machinery for determining the angle between the at least two links on the kinematic chain.

11. The system according to claim 10 where the at least one angle sensor (6, 7) is positioned at one end of the at least one link on the kinematic chain and is formed as a segment sensor.

12. The system according to claim 7, where the at least one slave IMU (1, 2, 3, 4) includes more than one IMU (1, 2, 3, 4) and where the master IMU (5) is configured to calculate: the intermediate angles between the more than one slave IMUs (1, 2, 3, 4) and/or between the master IMU (5) and at least one of the more than one slave IMUs (1, 2, 3, 4) or the absolute angles of the more than one IMUs (1, 2, 3, 4, 5) to a reference taken from the analysed data.

* * * * *